US005888105A

United States Patent [19]

Brown et al.

[11] Patent Number: 5,888,105

[45] **Date of Patent: *Mar. 30, 1999**

[54] MULTI-STATION FEMALE BLADE RECEPTACLE STAMPING AND MULTI-OUTLET RECEPTACLE

[75] Inventors: Donald C. Brown, Freehold; Suzanne V. Hickey, Brick, both of N.J.

[73] Assignee: Heyco Products, Inc., Toms River, N.J.

[ * ] Notice: The term of this patent shall not extend beyond the expiration date of Pat. Nos. 5,586,920 and 5,443,400.

[21] Appl. No.: 734,044

[22] Filed: Oct. 18, 1996

Related U.S. Application Data

[63] Continuation-in-part of Ser. No. 389,946, Feb. 17, 1995, Pat. No. 5,586,920, and Ser. No. 137,347, Oct. 18, 1993, Pat. No. 5,443,400, and a continuation of Ser. No. 483,769, Jun. 7, 1995, abandoned.

[51] Int. Cl.[6] ..... H01R 11/22

[52] U.S. Cl. ..... 439/857; 439/650; 439/652

[58] Field of Search ..... 439/842, 843, 439/851–857, 861, 862, 374, 378, 736, 92, 108, 638–655, 709–715, 877

[56] References Cited

U.S. PATENT DOCUMENTS

| | | | |
|---|---|---|---|
| 3,487,356 | 12/1969 | Buck et al. | 439/861 |
| 4,354,727 | 10/1982 | Brown | 439/654 |
| 4,462,656 | 7/1984 | Beyer | 439/655 |
| 5,171,168 | 12/1992 | Chiodo | 439/651 |
| 5,342,219 | 8/1994 | Onodera et al. | 439/861 |
| 5,443,400 | 8/1995 | Brown et al. | 439/650 |
| 5,586,920 | 12/1996 | Brown | 439/857 |

*Primary Examiner*—Paula Bradley
*Assistant Examiner*—Tho D. Ta
*Attorney, Agent, or Firm*—Selitto & Associates

[57] ABSTRACT

A multi-station female blade receptacle stamping has female blade receptacles. Each receptacle is three sided, having a longitudinal opening. There is a flat side and curved side. The metal is resilient so that the curved side releases from the plastic when molded into a multi-outlet receptacle. In the multi-outlet receptacle, each female blade receptacle is supported against unwanted flexure and biased against a received blade, providing full surface contact on one side of the receptacle. The sides of the female blade receptacle do not fatigue in use. The multi-station female blade receptacle is economical of metal and adapted for automated crimping. The structure of the receptacle enables one size receptacle to serve blades of various widths and thicknesses. Molding multi-station female blade receptacle stampings into a multi-outlet receptacle saves crimping of multiple parts and can be effected in prior art molds. With a multi-station female ground pin receptacle stamping in the molded multi-outlet receptacle plugs with ground pins can be accepted by the outlets.

29 Claims, 5 Drawing Sheets

MULTI-STATION FEMALE BLADE RECEPTACLE STAMPING AND MULTI-OUTLET RECEPTACLE

The present invention is a continuation in part of application Serial No. 08/389,946 filed Feb. 17, 1995 entitled Blade Receptacle U.S. Pat. No. 5,586,920 and application Ser. No. 08/137,347 filed Oct. 18, 1993, entitled Multiple Outlet Receptacle and Metal Stamping. Therefor U.S. Pat. No. 5,443,400 and is a continuation of Ser. No. 08/483,759 filed Jun. 7, 1995 now abandoned.

BACKGROUND OF THE INVENTION

The present invention is a new multi-station female blade receptacle stamping electrical conductor, particularly useful in multiple outlet receptacles for the plugging in of electricity for machinery in a factory and for a wall outlet for the plugging in of power tools generally having heavy duty electrical cable. Such multiple outlet receptacles generally have a flat array of polarized outlets for the male plugs in a single head. The connector plugs usually have a round or "U" shaped ground pin and blades. Each outlet usually has an opening to accept a round or "U" shaped ground pin and polarized openings for the blades. There are usually three outlets on each receptacle.

The multi-station female blade receptacle stampings are preferably progressively stamped on a stamping strip. The multi-station female blade receptacle stamping can be machine crimped to conductor wires.

Prior art multiple outlet flat receptacles with three sets of outlets generally included nine female contacts and nine wire connections, three each, to each outlet.

Assembly of outlet receptacles required the connecting of nine wires to the nine female contacts, as well as the complexity of maintaining all parts together with load bars, during the molding process. The molding of the multi-station female blade receptacle stampings of the present invention can be done without changing prior art molds and load bars.

The manufacture of the prior art outlet receptacles also required substantial labor, to get, usually, nine wires and pieces together for the molding of an outlet receptacle, even if the wires were automatically machine crimped to the contacts.

Each station of the present invention has a stamped metal female blade receptacle having three sides and a longitudinal opening. There is a flat side and curved side. The metal is resilient so that the curved side releases from the plastic when molded into an outlet. In an outlet, each female blade receptacle is supported against unwanted flexure and biased against a received blade providing, full surface contact on one side of a female blade receptacle. The sides of each female blade receptacles do not fatigue in use. The multi-station stamping is economical of metal and adapted for automated crimping. The structure of the blade receptacle enables one size female blade receptacle to serve blades of various widths and thicknesses.

The multi-station female blade receptacle stamping may be used in automated procedures in conjunction with premolds, cores or spacers. Premolds, cores or spacers better enable machine crimping and enable easier and better positioning of the female blade receptacle stampings for final molding.

Multi-station female blade receptacle stampings can be provided, integral on a stamping strip for automated procedures.

DESCRIPTION OF THE RELATED ART

Prior female blade receptacles, such as a box contact, depended upon dimples or elevations, in order to assure a good electric contact. Such female receptacles were limited with regard to the width and thickness of the received blade, and further, tended to wear out at the dimple with repeated use, weakening the integrity of the electrical contact.

Another prior art female blade receptacle comprised two open arms in a bent, spring-like configuration, to grasp a blade. These connectors, while flexible as to both width and thickness of the blade, provided angulated contact of a limited nature.

Another prior art connector, in the form of a box, provided a longitudinal wall, overlain by another longitudinal wall, acting somewhat as a biasing spring, biasing the under wall to be in line contact with a blade and holding the blade fully against the opposite wall in good electrical contact. The problem with such a contact is that, as a box, it is limited with regard to any variations in blade widths and blade thicknesses. Such a contact also tends to fatigue in use at its corners and to also lose its spring-like resilience in maintaining electrical contact.

U.S. Pat. Nos. 5,586,920, 5,443,400, Ser. No. 08/483,759 filed Jun. 7, 1995 are incorporated herein by reference.

U.S. Pat. No. 4,530,562 discloses an electrical contact for a blade, with a pair of side portions and a pair of overhanging and overlapping portions extending from the side portions, to define an insertion region. The contact provides contact force between the contact and the blade, the blade biasing both overhanging portions when inserted.

U.S. Pat. No. 3,729,701 is exemplary of a typical prior art female electrical box-like receptacle for a typical tab.

U.S. Pat. No. 3,836,947 is exemplary of a typical prior art female electrical box-like receptacle for a male terminal with a dimple and a leaf spring.

U.S. Pat. No. 4,540,233 is exemplary of another typical prior art female electrical box-like receptacle block for a male terminal for improved contact.

U.S. Pat. No. 4,781,628 is exemplary of another typical prior art female electrical terminal having a resilient latch tang with structure to protect the latch tang, where the structure to protect the latch tang is part of an appendage which is juxtaposed the receptacle of the female terminal, providing versatility in configuring and sizing the receptacle itself.

U.S. Pat. No. 5,074,039 discloses a multi-opening electrical connector with separately acting contacts, molded and stamped, with multiple male and female connections.

U.S. Pat. No. 4,045,868 and 4,188,715 disclose a stamped and molded electrical connector with multiple connections and variously configured female and male contacts individually acting in a molded multi-opening receptacle, with individual wire connections for each female contact in the multiple plug. The contacts are press fit.

U.S. Pat. No. 3,668,615 discloses a receptacle for multiple male pins, each individually connected to a lead wire. The pins are crimped to conductors in a automated operation.

U.S. Pat. No. 5,044,993 discloses a connector system for different types of male and female contacts were the contacts are in a simplified one piece round configuration.

U.S. Pat. No. 4,546,542 discloses a stamped and molded electrical connector with multiple tine female contacts and male contacts individually acting in a molded multi-opening receptacle.

U.S. Pat. No. 5,148,596 discloses an assembly system for assembling multiple female contacts and multiple male contacts on a printed circuit board.

U.S. Pat. No. 4,863,402 discloses an assembly for assembling multiple female contacts where a conductor is accessable from more than one opening.

Japanese Patent No. 3-29221 discloses a single contact with multiple male contacts for a plug.

It is respectfully requested that this citation of art be made of record with regard to the within application.

SUMMARY OF THE INVENTION

The present invention is a multi-station female blade receptacle stamping for male blades or terminals. The female blade receptacle stamping of the present invention is a combination of the Blade Receptacle in copending application Serial No. 08/389,946 filed Feb. 17, 1995 U.S. Pat. No. 5,586,920, and the Multi-station Stamped Metal Female Receptacle of application Serial No. 08/137,347 filed Oct. 18, 1993 U.S. Pat. No. 5,443,400. The present invention is economical in using a minimum amount of metal, it saves labor cost by being adapted for automation and the flexibility of its shape enables effective full one side contact on a single side for a wide variety of male blade variants. The multi-station female blade receptacle stamping may first be used in a premold, core or spacer before being molded into a plug.

According to the present invention, the multi-station female blade receptacle stamping has a female blade receptacle stamping which has a spine, at least two stations, a female blade receptacle for each said station and a single crimp end. The spine is articulated for each station. Each said female receptacle has a flat side, a curved side and a back portion. The flat side and curved side extend longitudinally and substantially on a perpendicular plane from the back portion and substantially the length of the female receptacle. The curve of the curved side is longitudinal and convex, within the female receptacle, each side having longitudinal edges. The longitudinal edges are substantially parallel to each other and substantially the same height.

The female blade receptacle's curved side may be resilient and spring biased and the female blade receptacle's sides may have blade guide means. The blade guide means may be lips which may be flared.

The crimp end may have a pair of crimp arms. The female blade receptacles may be substantially evenly spaced from each other along the spine, the female blade receptacles may be offset from the spine on a horizontal plane and the sides of the female blade receptacles may be parallel to the spine.

The crimp end may be offset from the spine and parallel to the spine. The crimp arms may be at a right angle to the spine.

The multi-station female blade receptacle stamping may have three stations.

There may be a combination of a multi-outlet receptacle having at least two outlets in flat array, articulated with regard to each other, and having at least two openings for male contacts, and at least two multi-station female blade receptacle stampings. The multi-station female blade receptacle stampings have a spine, at least two stations, a female blade receptacle for each said station, and a single crimp end. The spine is articulated for each station. Each said female receptacle has a flat side, a curved side and a back portion. The flat side and curved side extend longitudinally and substantially on a perpendicular plane from the back portion and substantially the length of the female receptacle. The curve of the curved side is longitudinal and convex, within the female receptacle, each side having longitudinal edges. The longitudinal edges are substantially parallel to each other and substantially the same height. The stations are each oriented toward one of the outlets. The female blade receptacles are oriented to access one opening in the outlet. There are conductor wires for the multi-station female blade receptacle stampings crimped at the crimp end.

The multi-outlet receptacle may have three outlets which may have three openings including a ground pin opening. The multi-outlet receptacle may have three multi-station female receptacles stampings on the stamping including female ground pin receptacles.

The female blade receptacle's curved side may be resilient and spring biased and the female blade receptacle's sides may have blade guide means. The blade guide means may be lips which may be flared.

The crimp end may have a pair of crimp arms. The female blade receptacles may be substantially evenly spaced from each other along the spine and the female blade receptacles may be offset from the spine on a horizontal plane and the sides of the female blade receptacles the may be parallel to the spine.

The crimp end may be offset from the spine and parallel to the spine. The crimp arms may be at a right angle to the spine.

The multi-station female blade receptacle stamping may have three stations.

Although such novel feature or features believed to be characteristic of the invention are pointed out in the claims, the invention and the manner in which it may be carried out, may be further understood by reference to the description following and the accompanying drawing.

BRIEF DESCRIPTION OF THE DRAWINGS

Referring now to the figures in greater detail, where like reference numbers denote like parts in the various figures.

DESCRIPTION OF THE PREFERRED EMBODIMENTS

Figure 1:
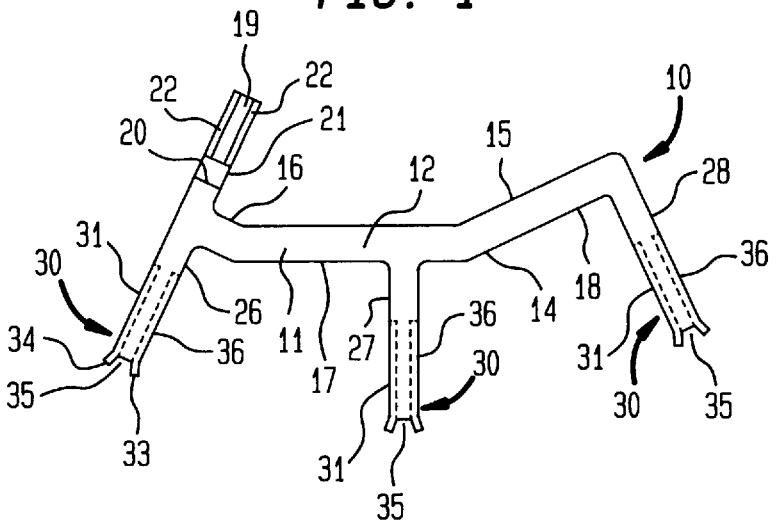
FIG. 1 is a top plan view of a multi-station female blade receptacle stamping of the present invention.

The multi-station female blade receptacle stamping 10, as seen in FIGS. 1–4, has a spine 11. The spine 11 has a top portion 12, a bottom portion 13, a front side 14 and a rear side 15. The spine 11 is articulated into three stations 16, 17, 18. Three female blade receptacles 30 extend from the spine 11 from the 14, one from each station 16, 17, 18. On the rear side 15, as can best be seen in FIGS. 1 and 3, there is a an extending crimp end 19. The crimp end 19 includes a right angle tab 20 extending downward below the top portion 12 and a right angulated tab 21 extends rearward below the bottom 13 of the spine 11 and parallel to the plane of the top and bottom portions 12, 13. Crimp arms 22 extend at a right angle to the tab 21, spaced apart the width of the tab 21, toward the plane of the top and bottom portions 12, 13. Each station 16, 17 and 18 has a respective extension 26, 27 and 28 to which an integral female blade receptacle 30 is connected.

The female receptacles 30 extend downward below the bottom 13 of the spine 11.

Figure 2:
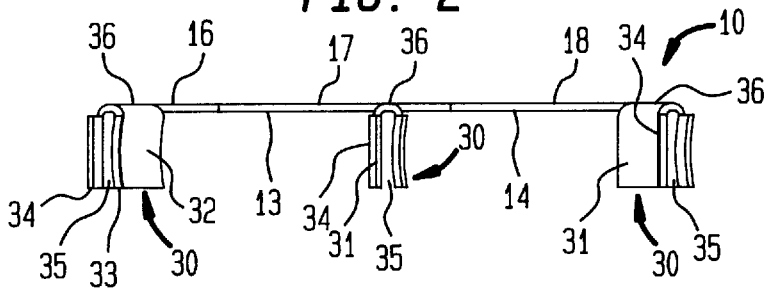
FIG. 2 is a front elevation of FIG. 1.
Figure 3:
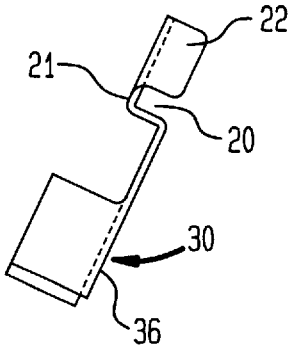
FIG. 3 is a left side elevation of FIG. 1.
Figure 4:
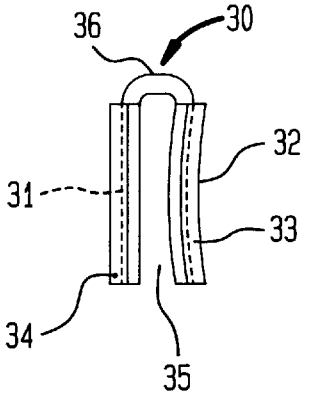
FIG. 4 is a detail front elevation of a female blade receptacle stamping of of FIG. 2.

FIG. 4 shows an enlarged detail of the female receptacle 30 of FIGS. 1–3 with the opening 35 and the flared lips 34, 33.

The female receptacle 30 comprises a flat side 31, a curved side 32 and a back portion 36 from which the flat side 31 and curved side 32 extend. The female receptacle 30 has a flared lip guide 33 on the curved side 32 and a flared guide lip 34 on the flat side 31.

The flat side 31 and curved side 32 define an opening 35 to receive a blade.

Figure 5:
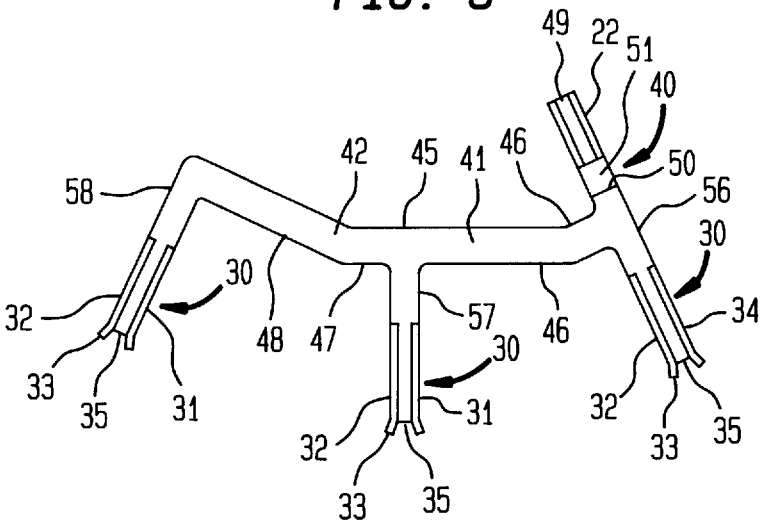
FIG. 5 is a top plan view of another embodiment of the multi-station female blade receptacle stamping of the present invention.
Figure 6:
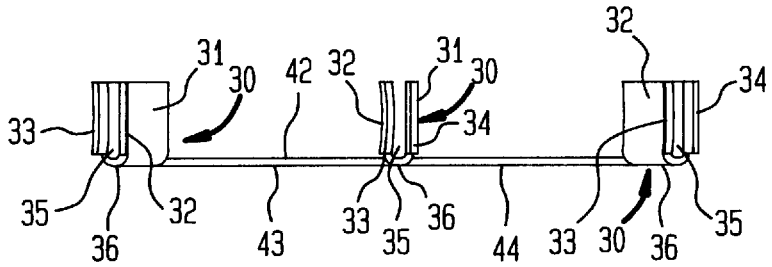
FIG. 6 is a front elevation of FIG. 5.
Figure 7:
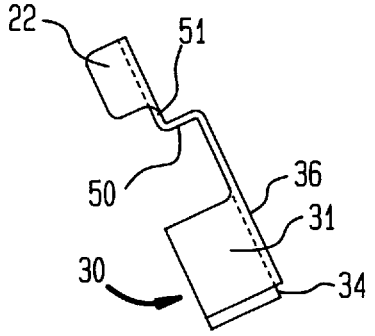
FIG. 7 is a right side elevation of FIG. 5.

The multi-station female blade receptacle stamping 40, as seen in FIGS. 5–7, has a spine 41. The spine 41 has a top portion 42, a bottom portion 43, a front side 44 and a rear side 45. The spine 41 is articulated into three stations 46, 47, 48. Three female blade receptacles 30 extend from the spine 41 from the front side front side 44, one from each station 46, 47, 48. On the rear side 45, as can best be seen in in FIGS. 5 and 7, there is a an extending crimp end 49. The crimp end 49 includes a right angle tab 50 extending upward above the top portion 42, and a right angulated tab 51 extends rearward above the top 42 of the spine 41 and parallel to the plane of the top and bottom portions 42, 43. Crimp arms 22 extend at a right angle to the tab 51 spaced apart the width of the tab 51 and above the plane of the top and bottom portions 42, 43. Each station 46, 47 and 47 has a respective extension 56, 57 and 58 to which an integral female receptacle 30 is connected.

The female receptacles 30 extend upward above the top 42 of the spine 41, just inverted in position from the female receptacles 30 in the multi-station female blade receptacle stamping 10.

Figure 8:
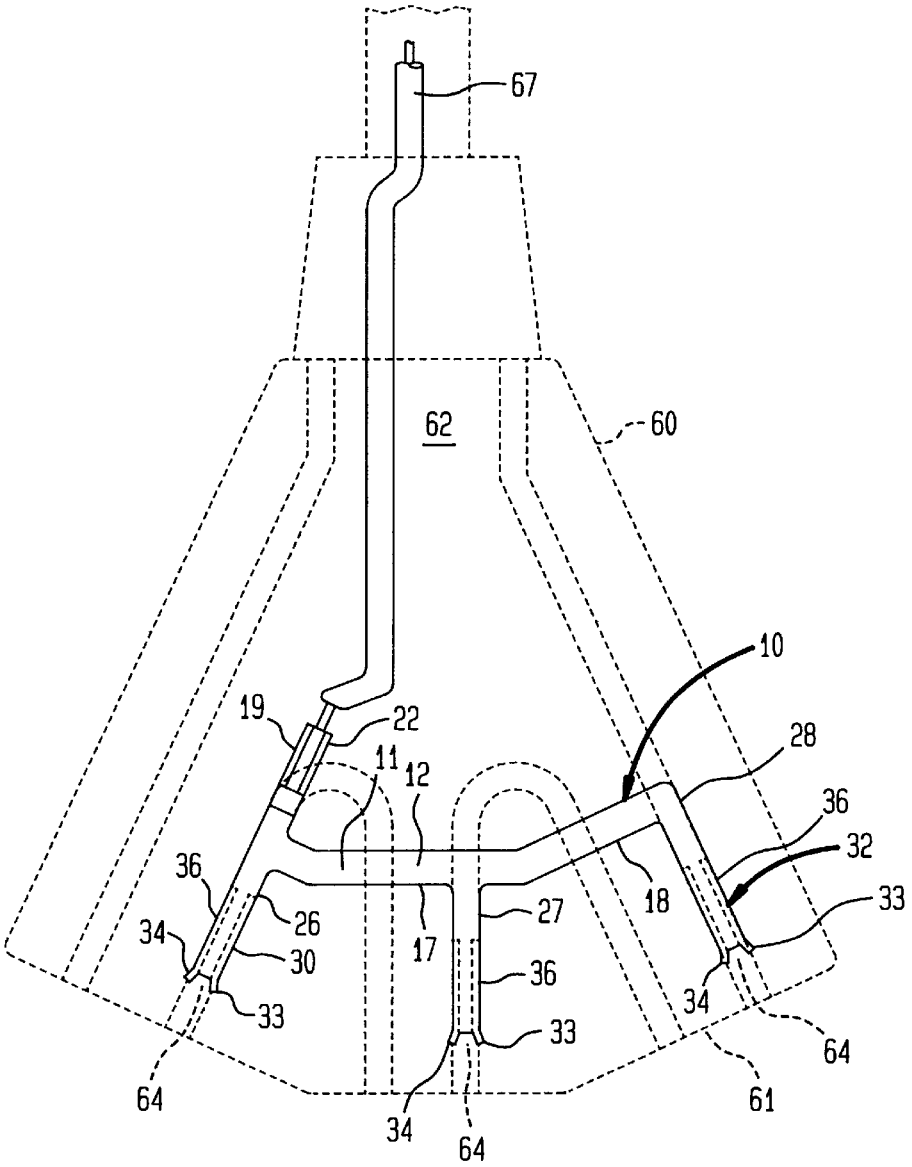
FIG. 8 is a phantom top plan view of a molded multi-station outlet receptacle showing the embodiment of FIGS. 1–4 of the multi-station female blade receptacle stamping crimped to a conductor.
Figure 9:
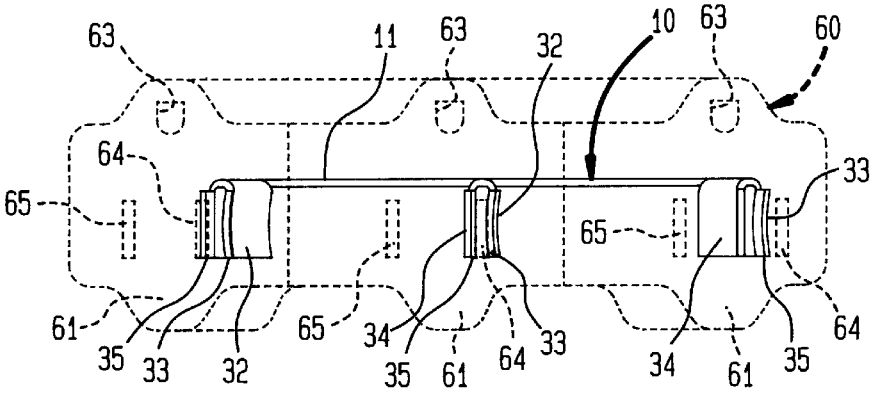
FIG. 9 is a front elevation of FIG. 8.

As shown in phantom in FIGS. 8 and 9, a multiple outlet receptacle 60 has three outlets 61 in flat array in the head 62. As shown in FIG. 9, the outlets 61 are preferably polarized with a ground pin opening 63, a first polarized blade opening 64 and a second blade opening 65. The ground pin opening 63 is centered at the top of the array in each outlet 61.

As shown in FIG. 8, an insulated conductor wire 67 is crimped to a multi-station female blade receptacle 10 with stations 16, 17, and 18 on an articulated spine 11. Each station has a female blade receptacle 30 including an opening 35 for blade contacts (not shown). The stations 16, 17 and 18 are articulated to address the outlets 61 so that the blade contacts of a plug (not shown) may enter the outlet 61 opening 64 and engage the female blade receptacle opening 35.

Figure 10:
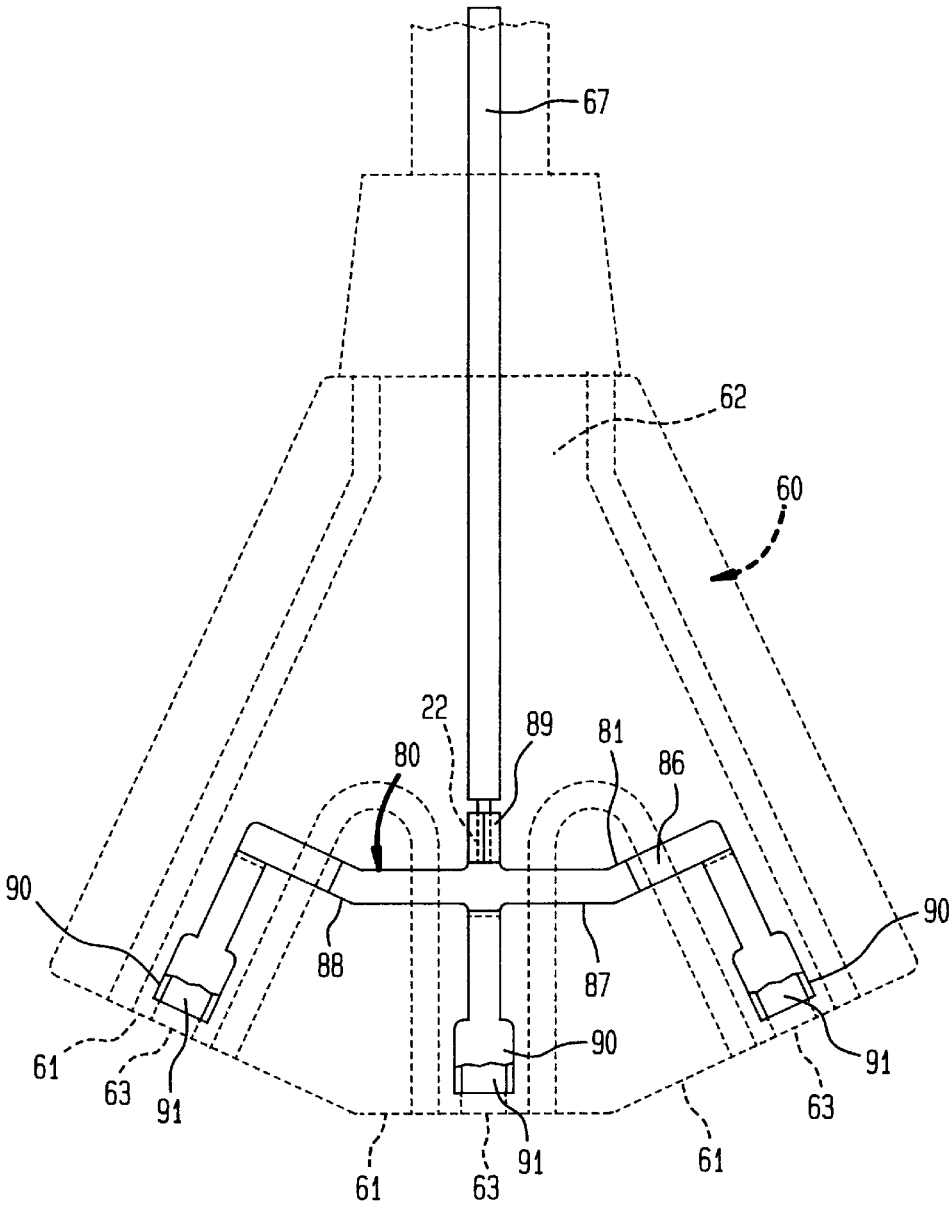
FIG. 10 is top plan view of FIG. 8, showing the receptacle, in phantom, with an articulated multi-station female ground pin receptacle stamping, cut away, crimped to a conductor wire.
Figure 11:
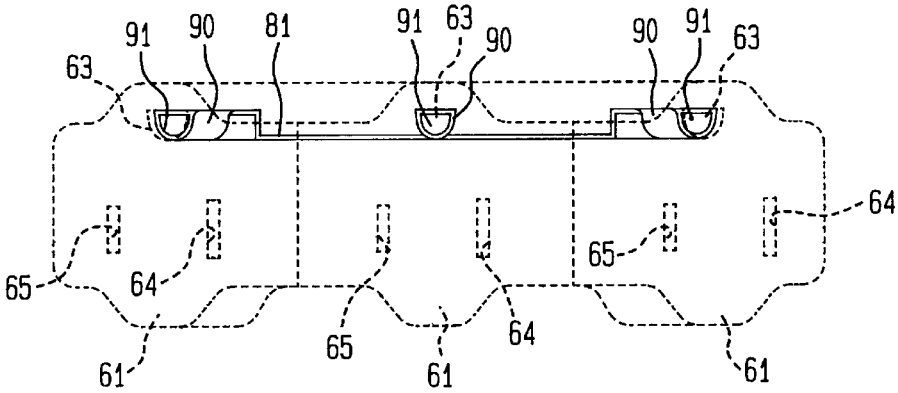
FIG. 11 is a front elevation of FIG. 10.

As shown in FIGS. 10 and 11, the multiple outlet receptacle 60 includes a multi-station ground pin receptacle stamping 80 in the head 62. The multi-station ground pin receptacle stamping 80 has a spine 81 from which extends a wire crimp end 89 with crimp arms 22. The multi-station ground pin receptacle stamping 80 has a first station 86, a second station 87 and a third station 88. Each station 86–88 has a female ground pin receptacle 90 for a round or "U" shaped pin and an opening 91 to accept a round or "U" shaped pin.

As shown in FIG. 10, an insulated conductor wire 67 is crimped to the multi-station female ground pin receptacle stamping 80 which includes stations 86, 87, and 88 on an articulated spine 81. Each station has a female ground pin receptacle 90 including an opening 91 for ground pins (not shown). The stations 86, 87 and 88 are articulated to address the outlets 61 so that the ground pins (not shown) may enter the outlet opening 63 and engage the female ground pin receptacle opening 91.

Figure 12:
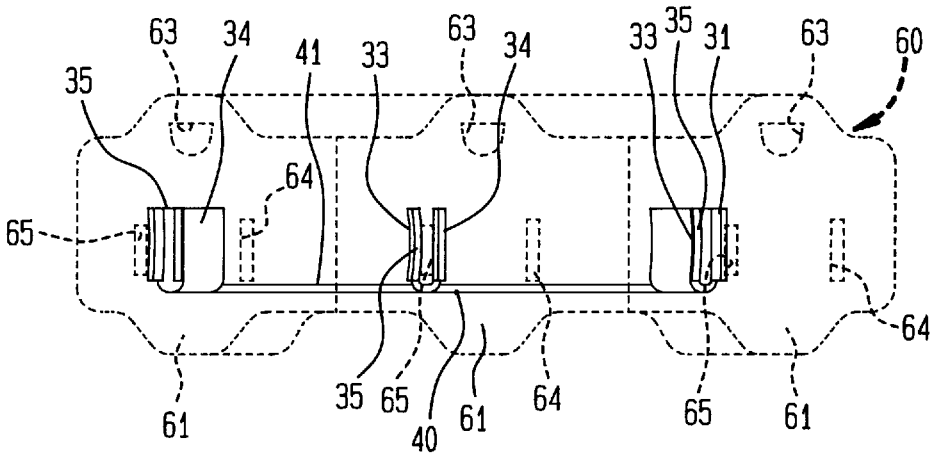
FIG. 12 is a phantom front elevation view of a molded multi-station outlet receptacle showing the embodiment of FIGS. 5–7 of the multi-station female blade receptacle stamping crimped to a conductor.

As shown in phantom in FIG. 12, the multiple outlet receptacle 60 of FIGS. 8 and 9 has three outlets 61 in flat array in the head 62. An insulated conductor wire 67 (not shown in FIG. 12) is crimped to a multi-station female blade receptacle 40 with stations 46, 47, and 48 on an articulated spine 41. Each station has a female blade receptacle 30 including an opening 35 for blade contacts (not shown). The stations 46, 47 and 48 are articulated to address the outlets 61 so that the blade contacts of a plug (not shown) may enter the outlet 61 opening 65 and engage the female blade receptacle opening 35.

OPERATION

The multiple outlet receptacle 60 is preferably molded in plastic and includes a cable (not shown) with three insulated conductor wires 67. As shown in FIGS. 8 and 9, a stamped metal multi-station female receptacle 10 is molded into the head 62 of the multiple outlet receptacle 60 with an insulated conductor wire 67 crimped to the crimp arms 22.

The multi-station female blade receptacle stamping 40 is almost identical to the multi-station female blade receptacle stamping 10, with the exception that tab 50 in the crimp end 49 extends above the top 42 of the spine 41, the female blade receptacles 30 are inverted and extend above the top 42 of the spine 41. The spine 41 is a mirror image of the spine 11 with the crimp end 49 on the side opposite that of the multi-station female blade receptacle stamping 10.

The differences between the multi-station female blade receptacle stampings 10 and 40 are a convenience for aligning them in the molding of a multiple outlet receptacle 60 offset to access the second blade opening 65, as shown in FIG. 12.

The usual multiple outlet receptacle 60 includes outlets 61 with ground pin openings 63 so that two bladed plugs (not shown) or plugs, including round ground pins, (not shown) may be freely engaged. Thus, a multi-station female ground pin receptacle stamping is preferably molded into the multiple outlet receptacle 60 and aligned to the ground pin opening 63.

The stations 16, 17 and 18 are articulated to address the outlets 61 so that the ground pin and blade contacts of a plug (not shown) may enter the outlet openings 63, 64 and 65 and engage the various female contact receptacle openings.

The stations 46, 47 and 78 are articulated to address the outlets 61 so that the ground pin and blade contacts of a plug (not shown) may enter the outlet openings 63, 64 and 65 and engage the various female contact receptacle openings.

An insulated conductor wire 67 crimped to the crimp arms 22 of the multi-station female receptacle stampings 10, 40, serves stations 16, 17 and 18 and 46, 47 and 48, replacing the prior art individual contacts having multiple crimped wires. Multi-station ground pin receptacle stampings, of course, may use the same system.

In molding, the multi-station female receptacle stampings 10, 40 spacers (not shown) may be used to prevent against possible unwanted misalignment of the multi-station contacts during the molding process.

During the molding process, load bars or plugs, (not shown) equivalent to "D" shaped pins and flat blades, are loaded into the mold. The openings 63 engage the load bar equivalent of pins and the openings 64, 65 engage the load bar equivalent blades. The load bars and the mold shape the openings 63, 64 and 65, which define the outlets 61.

The opening 35 is adapted to receive various widths and thicknesses of of contact blades.

The present invention is adapted to automation in the making of multi-station outlet receptacles 60. The multi-station female blade receptacle stampings 10, 40 may be progressively stamped on a stamping strip (not shown), put on reels (not shown) and fed into crimping machines where insulated cable wires 67 may be automatically crimped, placed into a mold (not shown) and engaged on load bars (not shown) molding.

When the female blade receptacle 30 is engaged by a blade or on a load bar, the curved side 32 is resilient and is naturally spread open during the molding process. Thus, once molded, with the load bar removed, the curved side 32 tends to separate from the molding plastic and has room to flex, directly supported by the molding plastic. By the same token, the mold will support the curved side 32, after molding.

The gentle curvature and resilient spring biasing of the metal of the curved side 32 causes full surface electrical contact on the flat side 31 of the female blade receptacle 30 with one side of a male blade, self positioning the blade.

There are other multi-station female blade receptacle stampings that can receive blades as disclosed in copending application Ser. No. 08/137,347 filed Oct. 18, 1993 entitled A Multiple Outlet Receptacle and Metal Stamping Therefor. Such receptacles do not have the full surface electrical contact between a contact blade and a flat side of female blade receptacle.

The multi-station female blade receptacle stamping 10, 40 of the present invention utilizes the advantages of copending application Ser. No. 08/389,946 filed Feb. 17, 1995, entitled Blade Receptacle, so that an engaged blade in a multi-station stamping has full surface contact on one side of a female blade receptacle 30, even though a blade may vary in width and thickness. The receptacle 30 is simple, economical to produce, with an economy of metal and minimized risk of fatiguing.

There is no risk of distorting the female blade receptacle 30 by different size blades as might occur with some contacts of the prior art.

The flared guide lips 33 and 34 add to the self positioning of the male blade. There is only a small play from the center of the curve of the curved side 32 to the back portion 36, substantially lessening the likelihood of fatigue, weakening or breaking of the blade receptacle and the consequent loss of excellent one side full contact with a blade in continuous use. The molded plastic in the head 62 of the multi-station outlet receptacles 60 limits the travel of the curved side 32 and supports it along its total surface, helping to limit fatigue and to help maintain the male blade in the opening 35 of the female blade receptacle 30.

The present invention provides one female blade receptacle 30 having a flat side 31, a curved side 32 and a back portion 36 molded into the head 62 of a multi-station outlet receptacle 60 including multiple station female blade receptacle stampings 10, 40 enables an outlet 61 to accept a plug with a ground pin (not shown).

Although not shown in detail in the figures, optional positions for the placement of the crimp ends 19, 49, different facing directions of the openings 35 and the tabs 20, 21, 50, 51 are consistent with the objectives of automation, simplicity, economy and efficiency of the present invention.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A multi-station female blade receptacle stamping, comprising a spine having at least two stations, said spine being articulated for each of said at least two stations, a female blade receptacle for each of said at least two stations, and a single crimp end, each female blade receptacle extending outwardly from said spine and including a flat side, a curved side, a back portion connected to said spine, and an outer end positioned distal from said spine, said flat side and said curved side extending perpendicular to said back portion and extending from said back portion to said outer end of said female blade receptacle, said flat side and said curved side each having an outer edge opposite said back portion, said outer edges being substantially parallel to each other and being substantially the same height, said curved side being convex within said female receptacle.

2. A multi-female blade receptacle stamping according to claim 1, wherein said curved side of each of said female blade receptacles is resilient and spring biased.

3. A multi-station female blade receptacle stamping according to claim 1, wherein said crimp end includes a pair of crimp arms.

4. A multi-station female blade receptacle stamping according to claim 1, wherein said female blade receptacles are substantially evenly spaced from each other along said spine.

5. A multi-station female blade receptacle stamping according to claim 1, wherein said spine includes three stations.

6. A multi-station female blade receptacle stamping according to claim 1, wherein said flat side of each of said female blade receptacles includes blade guide means, and wherein said curved side of each of said female blade receptacles includes blade guide means.

7. A multi-station female blade receptacle stamping according to claim 6, wherein each of said blade guide means includes a lip.

8. A multi-station female blade receptacle stamping according to claim 7, wherein each of said lips is flared.

9. A multi-station female blade receptacle stamping according to claim 1, wherein each female blade receptacle is offset from said spine in a horizontal plane.

10. A multi-station female blade receptacle stamping according to claim 9, wherein said flat side of each of said female blade receptacles lies in a plane which is parallel to said spine, and wherein said curved side of each of said female blade receptacles lies substantially in a plane which is parallel to said spine.

11. A multi-station female blade receptacle stamping according to claim 1, wherein said crimp end is offset from said spine.

12. A multi-station female blade receptacle stamping according to claim 11, wherein said crimp end is parallel to said spine.

13. A multi-station female blade receptacle stamping according to claim 11, wherein said crimp end includes a pair of crimp arms, each of said crimp arms being perpendicular to said spine.

14. In combination, a multi-outlet receptacle including at least two outlets arranged in a flat array and articulated with regard to each other, each of said at least two outlets including at least two openings for male contacts; at least two multi-station female blade receptacle stampings, each of said at least two multi-station female blade receptacle stampings including a spine having at least two stations, said spine being articulated for each of said at least two stations, a female blade receptacle for each of said at least two stations, and a single crimp end, each female blade receptacle extending outwardly from said spine and including a flat side, a curved side, a back portion connected to said spine, and an outer end positioned distal from said spine, said flat side and said curved side extending perpendicular to said back portion and extending from said back portion to said outer end of said female blade receptacle, said flat side and said curved side each having an outer edge opposite said back portion, said outer edges being substantially parallel to each other and being substantially the same height, said curved side being convex within said female receptacle, each of said at least two stations being oriented toward one of said at least two outlets, each female blade receptacle being oriented to access one of said at least two openings in one of said at least two outlets; and at least two conductor wires, one conductor wire corresponding to each of said multi-station female blade receptacle stampings, each of said conductor wires being crimped to said crimp end of the corresponding multi-station female blade receptacle stamping.

15. The combination of claim 14, wherein said curved side of each of said female blade receptacles is resilient and spring biased.

16. The combination of claim 14, wherein said crimp end of each of said multi-station female blade receptacle stampings includes a pair of crimp arms.

17. The combination of claim 14, wherein said female blade receptacles are substantially evenly spaced from each other along said spine.

18. The combination of claim 14, wherein each of said at least two multi-station female blade receptacle stampings includes three stations.

19. The combination of claim 14, wherein said multi-outlet receptacle includes three outlets.

20. The combination of claim 19, wherein each of said outlets includes a ground pin opening.

21. The combination of claim 20, wherein said multi-outlet receptacle includes three multi-station female receptacle stampings, one of said stampings including female ground pin receptacles.

22. The combination of claim 14, wherein said flat side of each of said female blade receptacles includes blade guide means, and wherein said curved side of each of said female blade receptacles includes blade guide means.

23. The combination of claim 22, wherein each of said blade guide means includes a lip.

24. The combination of claim 23, wherein each of said lips is flared.

25. The combination of claim 14, wherein each female blade receptacle is offset from said spine in a horizontal plane.

26. The combination of claim 25, wherein said flat side of each of said female blade receptacles lies in a plane which is parallel to said spine, and wherein said curved side of each of said female blade receptacles lies substantially in a plane which is parallel to said spine.

27. The combination of claim 14, wherein said crimp end of each of said multi-station female blade receptacle stampings is offset from said spine.

28. The combination of claim 27, wherein each of said crimp ends is parallel to said spine.

29. The combination of claim 27, wherein each of said crimp ends includes a pair of crimp arms, each of said crimp arms being perpendicular to said spine.

* * * * *